US009392877B2

(12) United States Patent
Khambete et al.

(10) Patent No.: US 9,392,877 B2
(45) Date of Patent: Jul. 19, 2016

(54) TUNABLE SPRING MATTRESS AND METHOD OF MAKING SAME

(71) Applicant: IndraTech LLC, Auburn Hills, MI (US)

(72) Inventors: Surendra S. Khambete, West Bloomfield, MI (US); Scott W. Lewis, Utica, MI (US); Matthew Scott Heinrich, Royal Oak, MI (US)

(73) Assignee: INDRATECH LLC, Troy, MI (US)

( * ) Notice: Subject to any disclaimer, the term of this patent is extended or adjusted under 35 U.S.C. 154(b) by 0 days.

(21) Appl. No.: 14/619,427

(22) Filed: Feb. 11, 2015

(65) Prior Publication Data

US 2015/0150384 A1 Jun. 4, 2015

Related U.S. Application Data

(63) Continuation-in-part of application No. 14/332,732, filed on Jul. 16, 2014, now Pat. No. 8,959,686, which is a continuation of application No. 13/157,540, filed on Jun. 10, 2011, now Pat. No. 8,813,286.

(60) Provisional application No. 61/353,287, filed on Jun. 10, 2010, provisional application No. 61/491,438, filed on May 31, 2011.

(51) Int. Cl.

| | |
|---|---|
| ***A47C 23/04*** | (2006.01) |
| ***A47C 27/12*** | (2006.01) |
| ***A47C 27/06*** | (2006.01) |
| ***D04H 13/00*** | (2006.01) |
| ***A47C 27/07*** | (2006.01) |

(52) U.S. Cl.

CPC ..... *A47C 27/12* (2013.01); *A47C 27/06* (2013.01); *A47C 27/061* (2013.01); *A47C 27/062* (2013.01); *A47C 27/07* (2013.01); *D04H 13/00* (2013.01); *D10B 2331/04* (2013.01); *Y10T 442/184* (2015.04); *Y10T 442/60* (2015.04)

(58) Field of Classification Search

CPC ..... A47C 23/04
USPC ..... 5/261, 716, 720, 655.7, 655.8; 428/113
See application file for complete search history.

(56) References Cited

U.S. PATENT DOCUMENTS

| | | | | |
|---|---|---|---|---|
| 7,625,629 | B2 | 12/2009 | Takaoka | |
| 7,993,734 | B2 | 8/2011 | Takaoka | |
| 2002/0166174 | A1* | 11/2002 | Bullard | 5/655.7 |

* cited by examiner

*Primary Examiner* — Fredrick Conley
(74) *Attorney, Agent, or Firm* — Carlson, Gaskey & Olds, P.C.

(57) ABSTRACT

A mattress includes a spring extending between first and second points to provide a first spring rate in a first direction. A polymer fiber structure is provided between the first and second points and adjoins the spring. The polymer fiber structure includes fibers interlinked with one another to provide the second spring rate in the first direction. An example method of manufacturing a mattress is provided that includes arranging springs to provide a mattress innerspring. A polymer fiber structure is introduced in a first state to the innerspring to provide an assembly. The assembly is further processed and the polymer fiber structure is simultaneously altered from the first state to a second state.

16 Claims, 6 Drawing Sheets

TUNABLE SPRING MATTRESS AND METHOD OF MAKING SAME

RELATED APPLICATIONS

This application is a continuation-in-part of prior U.S. application Ser. No. 14/332,732, filed Jul. 16, 2014, which is a continuation of prior U.S. application Ser. No. 13/157,540, filed Jun. 10, 2011 and now issued as U.S. Pat. No. 8,813,286. The '540 Application claims the benefit of U.S. Provisional Application Nos. 61/353,287 and 61/491,438, respectively filed on Jun. 10, 2010 and May 31, 2011.

The '732 Application, the '540 Application, the '287 Provisional Application, and the '438 Provisional Application are herein incorporated by reference in their entirety.

BACKGROUND

This disclosure relates to mattresses, and more particularly, the disclosure relates to the use of polymer fiber structures for tuning characteristics of the mattress. Methods of tuning a mattress are also disclosed.

Most sitting and sleeping surfaces today have a combination of coil springs and foam. Manufacturers attempt to tune the feel of the spring/foam combination to achieve durability and comfort. In most or all instances manufacturers attempt to refine the tuning characteristics of the mattress or seating cores by manipulating motion transfer, vibration, damping, zones within the seating or sleeping surface, and/or load/deflection curves.

Foam is used in most mattresses. Foam chemistries have been manipulated to create a conventional inexpensive polyurethane foam core to a fairly expensive viscoelastic foam core. Foam has also been used on the outside of a spring core assembly, or innerspring, as topper layers and as rails or skirts. Current typical spring core constructions might also include a bonnell construction, which is fairly inexpensive, or a complex pocket coil construction, which is a spring within a spring. Another type of construction is to provide a foam slab or core without using a coil spring core.

Almost all spring core mattresses adjust tuning characteristics by connecting the springs a certain way or giving the spring a certain predefined stress. However, some mattresses have utilized foam structures inserts in the spring core to tune the spring core assembly. Such mattresses are difficult to process during manufacture, are expensive and lack recyclability.

SUMMARY

A mattress includes a spring extending between first and second points to provide a first spring rate in a first direction. A polymer fiber structure is provided between the first and second points and adjoins the spring. The polymer fiber structure includes fibers interlinked with one another to provide the second spring rate in the first direction.

An example method of manufacturing a mattress is provided that includes arranging springs to provide a mattress innerspring. A polymer fiber structure is introduced in a first state to the innerspring to provide an assembly. The assembly is further processed and the polymer fiber structure is simultaneously altered from the first state to a second state.

BRIEF DESCRIPTION OF THE DRAWINGS

The disclosure can be further understood by reference to the following detailed description when considered in connection with the accompanying drawings wherein.

DETAILED DESCRIPTION

The disclosed mattress includes a polymer fiber structure that is introduced into the spring core assembly during the manufacturing process. In this disclosure, the terms "tuning block," "batt," and "polymer fiber structure" are used interchangeably. The polymer fiber structure adjust the tuning characteristics of the mattress to provide desired motion transfer, desired vibration, desired damping, desired zones within the seating or sleeping surface, and/or desired load/deflection curves.

In one example, the polymer fiber structure is a is an "engineered fiber," for example, a polyester fiber material. Other fiber types may include polypropylene, nylon, elastomers, co-polymers and its derivatives, mono-filaments, or bi-component filaments having different melting points. One type of polyester fiber includes a core polyester fiber sheathed in a polyester elastomer. Engineered fibers could be solid or hollow and have cross-sections that are circular or triangular. Another type of polyester fiber has a tangled, spring-like structure. Unlike the foam typically used in mattress construction, polyester is fully recyclable.

The fibers and their characteristics are selected to provide the desired tuning characteristics. One measurement of "feel" for a cushion is the Indentation Load Deflection, ILD, which is determined using industry guidelines. The ILD is the amount of pounds (measured as resistant force) required to compress a 4 inch thick, 15 inch×15 inch sample to 3 inches (or 25% of original height). In one example, a desired fiber blend provides a batt having a thickness of about 0.5-4.0 inches, an ILD of about 45-110 and a density of about 1.2-3.0 pounds per cubit foot.

At some point during manufacturing, for example, during the spring core manufacturing process, the polymer fiber structure is heated to interlink the fibers to one another to provide a more resilient structure. The fibers may be randomly oriented or directionally oriented, depending upon the desired characteristic.

Figure 1:
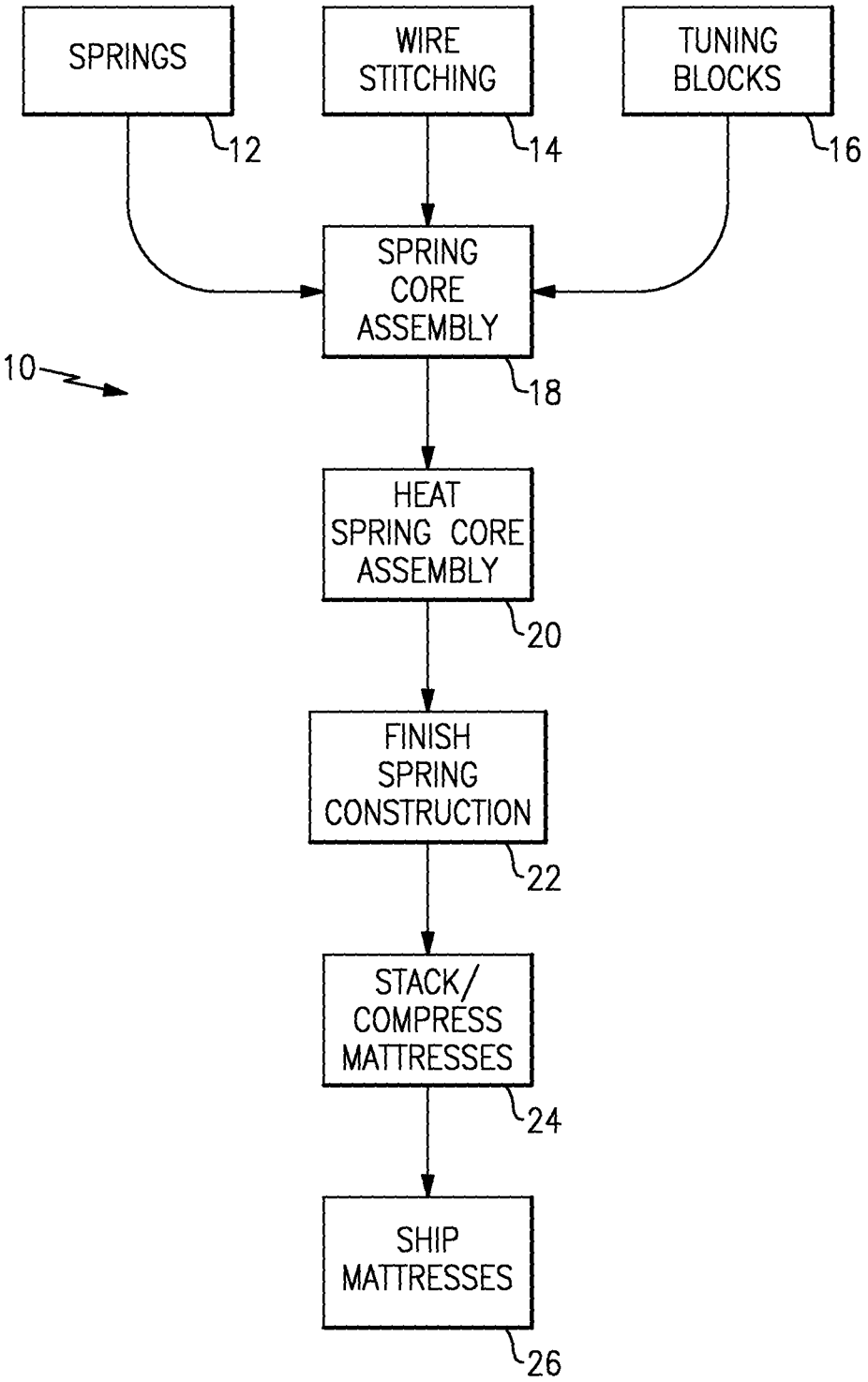
FIG. 1 is a flow chart of an example method of manufacturing the disclosed mattress.

FIG. 1 illustrates an example method 10 of manufacturing a spring core mattress assembly. Generally speaking, springs are arranged (block 12) with tuning blocks (block 16) at a common assembly area (block 18). This will be accomplished by first pre-cutting a certain form or shape from a blank, for example, of polyester material. This block material will have a specific density and blend to provide the desired tuning characteristics.

In one example, the pre-cut form is then introduced during the spring manufacturing process. Before and during the stitching process material can be introduced that will not inhibit the stitching process but will get embedded into the spring mechanism.

The springs are stitched together using wire (block 14) to provide a spring core assembly at the common assembly area 18. Typically each coil is made first and then 'stitched' together in the 'x' and 'y' and 'z' coordinate with additional wire. In one example, the coil spring core assembly is not arranged and wired together before the tuning blocks are inserted. Instead, the tuning blocks are inserted during spring core assembly.

Figure 2B:
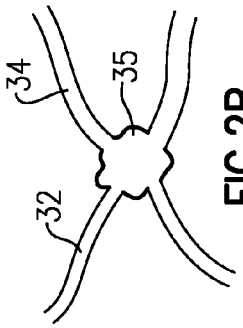
FIG. 2B illustrates fibers interlinked with one another.
Figure 2A:
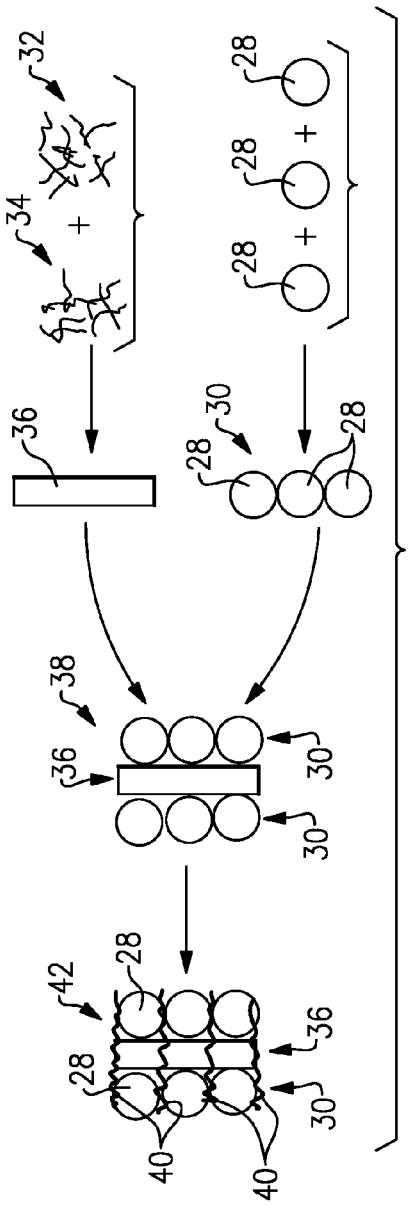
FIG. 2A is a schematic of a portion of the manufacturing process for spring mattresses depicted in the flow chart of FIG. 1.

Steps 12, 14, 16 and 18 are shown in more detail in FIG. 2A. Individual springs 28, for example, supplied by a chute, are arranged in an assembly area (block 18) to provide an array 30 of coil springs. The spring 28 is a metallic coil spring, for example, helical and general cylindrical in shape. It should be understood that the spring can also be constructed of plastic. A tuning block 36 having desired characteristics, such as density, may be provided by blending different polyester fibers 32, 34 with one another.

The tuning block 36 may be provided in any suitable shape, for example, in a rectangular block. The polymer fiber structure is introduced in a first state to the innerspring to provide an assembly. For example, the first state may correspond to an uncured condition and/or an uncompressed condition. The assembly is further processed, for example, heating and/or compressing, and the polymer fiber structure is simultaneously altered from the first state to a second state. The second state may correspond to a cured condition and/or a post-compressed condition.

Figure 4:
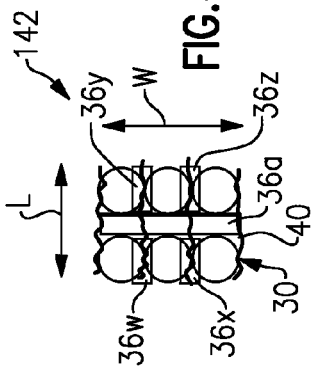
FIG. 4 is a perspective view of a portion of an alternative spring core assembly construction.
Figure 3A:
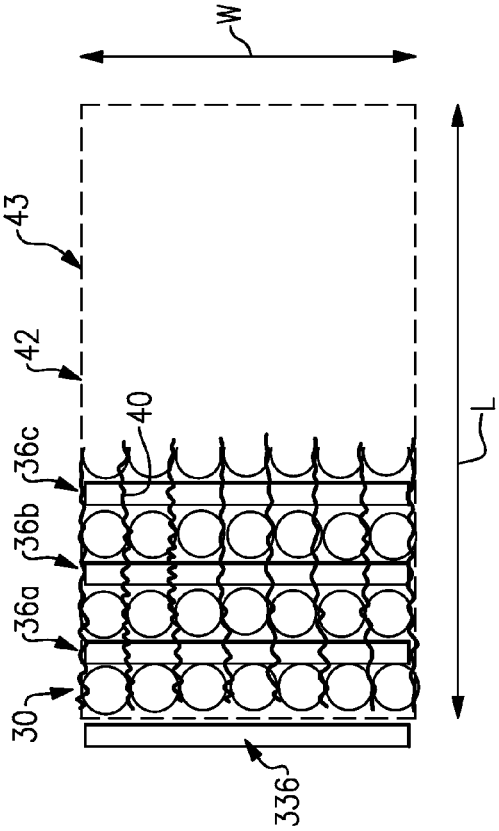
FIG. 3A is a top elevational view of an example spring core assembly.

The arrays of coils 30 and tuning blocks 36 are arranged in a desired configuration to provide desired overall spring core assembly tuning in a coil/tuning block configuration 38. Three example configurations are illustrated in FIGS. 3A, 4 and 5, although other configurations may be used as well. The individual coils 28 are secured to one another with wiring 40 to provide a tuned spring core assembly 42. The tuning blocks 36 may be arranged in the same direction as and/or transverse to the direction of the wires 40.

The polymer fiber structure is provided by an elongated batt having a generally rectangular cross-section. The batt has an initial installed condition, with the generally rectangular batt provided between rows of springs 28.

Figure 3B:
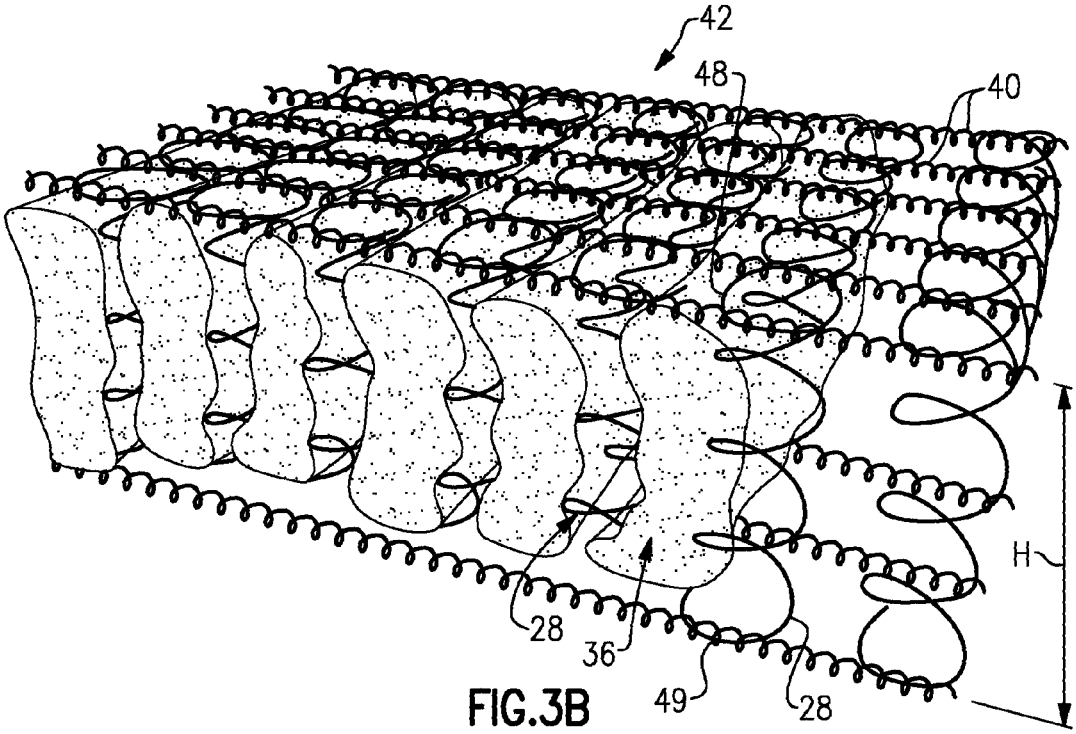
FIG. 3B is a perspective view of the spring core assembly illustrated in FIG. 3A in an initial installed condition.

The spring core assembly 42 is shown in more detail in FIGS. 3A and 3B. The spring core assembly 42 has a length L and a width W and height H providing x, y, z directions. The spring 28 extends between first and second points 48, 49 to provide a first spring rate in a first direction H. The polymer fiber structure 36 is provided between the first and second points 48, 49 and adjoins and engages the spring 28. The polymer fiber structure 28 including fibers 32 and/or 34 interlinked with one another at bond points 35 (see FIG. 2B) to provide the second spring rate in the first direction H.

Figure 5A:
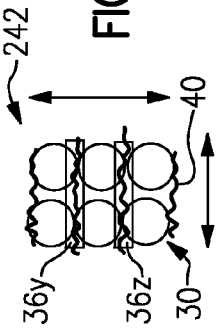
FIG. 5A is a perspective view of a portion of another alternative spring core assembly construction.

Tuning blocks 36A-36C having different densities than one another, for example, may be provided between the arrays 30 of coil springs. As a result, different locations of the mattress or support surface may be tuned based upon the application. As illustrated in FIGS. 4 and 5A, the tuning blocks (e.g., 36A, 36W-36Z) can be configured in various arrangements depending upon the desired spring core assembly tuning.

Returning to FIG. 1, typically the spring core assembly is sent to an oven (block 20) in which the spring core assembly is heated at approximately 400° F. for several hours. The heating operation anneals the coil springs to provide desired spring characteristics. At least some of the fibers may be a heat activated binder, for example. The heat activated binder may be formulated to melt during the heating step 20, providing the desired tuning block characteristics subsequent to the heating step.

Figure 3C:
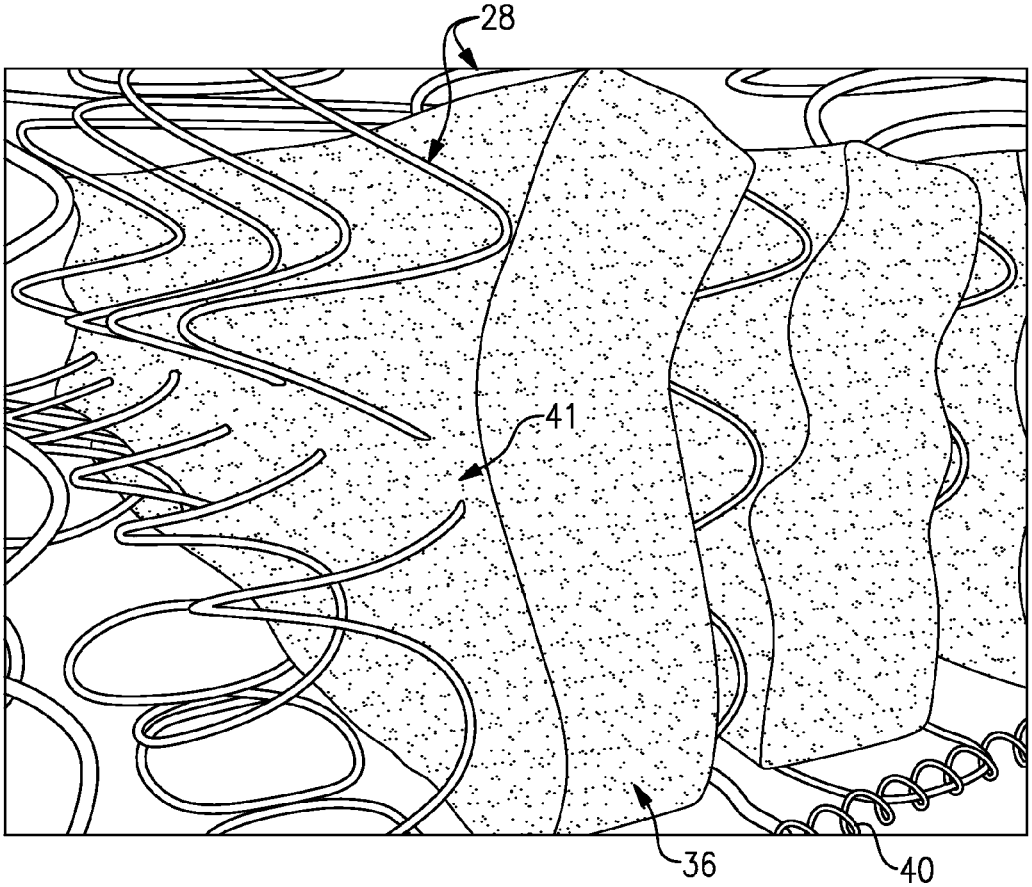
FIG. 3C is an enlarged perspective view of the spring core assembly shown in FIG. 3B.

During heating, the fibers of the batt 36 may become melted to the spring 28 in a region 41 (see FIG. 3C), which provides improved damping and vibration resistance.

Subsequent to heating, the spring core assembly is finished (block 22), for example, by providing topper layers, quilting, insulator pad, base pad, rail, and aesthetic cover to provide a finished mattress. These components also may be constructed of polyester material. The mattresses are stacked upon one another and compressed (block 24) to provide a compact arrangement suitable for shipping, as generally indicated at block 26.

Figure 5B:
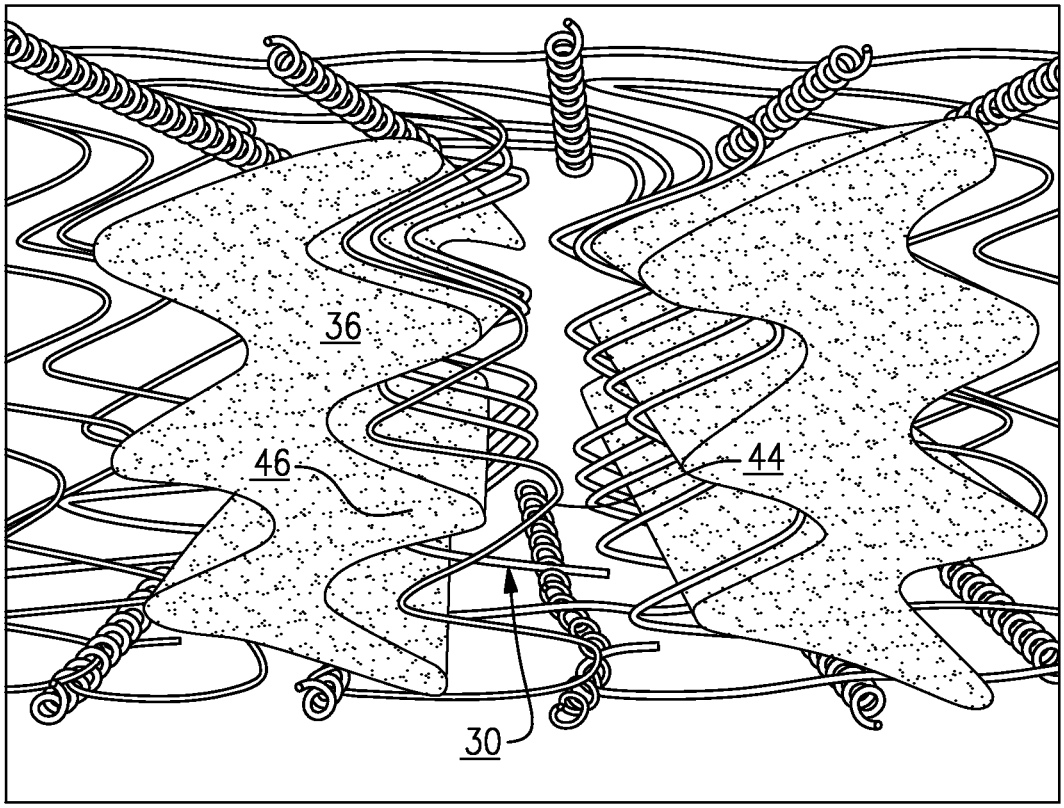
FIG. 5B is a perspective view of the spring core assembly shown in FIG. 5A in a post-compressed condition.

FIG. 5B illustrates a tuning block 36 subsequent to the compression indicated at block 24 in FIG. 1. The batt has a generally saw-toothed cross-section with peaks or wedges of the saw tooth arranged between coils of the springs 28 in a post-compressed condition. Once compressed, wedges 46 of the tuning blocks 36 are formed between coil turns 44 of the spring coil arrays 30. This may be desirable in that the tuning blocks 36 are able to better provide their tuning characteristics as the coils 28 are compressed during use. Thus, permanently deformed polymer fiber structure is provided between coils of the springs in the post-compressed condition.

Figure 6A:
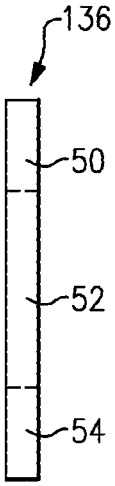
FIG. 6A is a schematic view of a tuning block having varying densities.
Figure 6B:
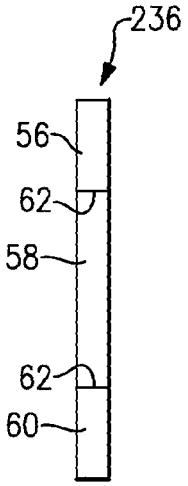
FIG. 6B is a schematic view of discrete blocks adhered to one another to provide an integrated tuning block.

Referring to FIGS. 6A and 6B, tuning blocks 136, 236 are provided that have a varying density. In the example illustrated in FIG. 6A, the tuning block 136 includes section or regions 50, 52, 54 having densities that are different than one another in a single block. In the example illustrated in FIG. 6B, the tuning block 236 is constructed from discrete blocks 56, 58, 60 that are adhered to one another at interfaces 62, such as by gluing the blocks 56, 58, 60 to one another.

Figure 6C:
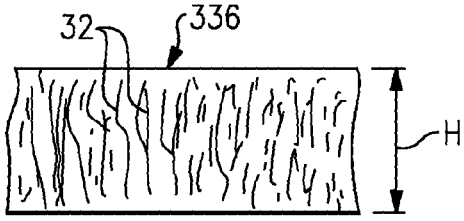
FIG. 6C is a schematic view of a polymer fiber structure having directionally oriented fibers.

In one example shown in FIG. 6C, the fibers 32 (and/or fibers 34) of a polymer fiber structure 336 are directionally oriented along the first direction H to provide an increased spring rate that provides the desired load/deflection curve, as compared to a spring rate of a polymer fiber structure comprising only randomly oriented fibers. In this example, the fibers 32 are oriented along a common direction, which is parallel to a height of the polymer fiber structure 336. In one example the directionally oriented fibers 32 are polyester fibers. Springs 28 are arranged to provide an innerspring or spring core assembly 42 having a perimeter 43, as shown in FIG. 3A. The polymer fiber structure 336 (see FIGS. 3A and 6C) is arranged at the perimeter 43 to provide a skirt or rail that is relatively rigid to better resist deflection from the weight of a sitting user. Although only one skirt is shown for simplicity, typically the skirt would be provided about the entire perimeter. The polymer fiber structure 336 may be positioned at other locations within the mattress to provided desired rigidity.

Figure 7:
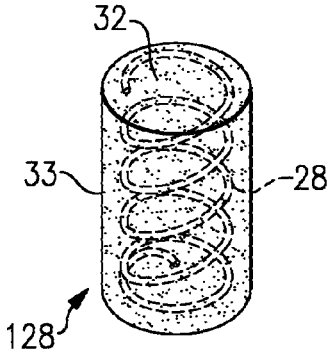
FIG. 7 illustrates a spring assembly.

In one example, the polymer fiber structure is arranged inside of the spring 28 to provide a spring assembly 128, as illustrated in FIG. 7. The assembly 128 may include an enclosure 33, such as a fine mesh, containing loose, unbonded fibers 32 (and/or fibers 34) in an uncured state within the spring 28. During heating, which may occur while heating the entire spring core assembly, the fibers become interlinked in a cured state.

Figure 8A:
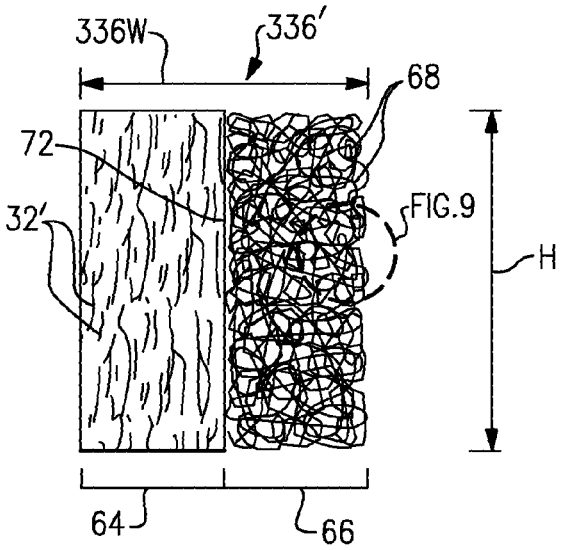
FIG. 8A is a schematic view of yet another polymer fiber structure, which includes a first section having directionally oriented fibers, and a second section including a netted layer.
Figure 9:
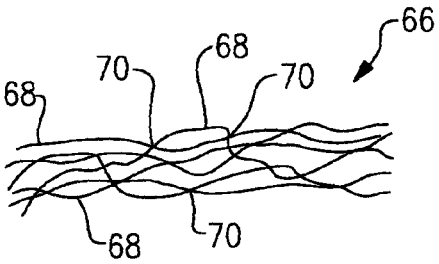
FIG. 9 is a close-up view of the netted layer of FIG. 8.

FIG. 8A illustrates another example polymer fiber structure 336', which may be used as a perimeter rail. As shown in FIG. 8A, the polymer fiber structure 336' includes a first section 64 and a second section 66 adjacent one another relative to the width 336W of the polymer fiber structure 336'. In this example, the first section 64 consists of directionally oriented fibers 32', which are the same as the directionally oriented fibers 32 discussed above relative to the polymer fiber structure 336 of FIG. 6C. The second section 66 is provided by a three-dimensional netted layer of a plurality of helically arranged thermoplastic resin filaments 68. Each of the thermoplastic resin filaments 68 is partially thermally bonded to at least one of the other thermoplastic resin filaments 68, at locations 70 (FIG. 9), such that the thermoplastic resin filaments 68 are randomly entangled with one another. One example of the netted layer of the second section 66 is disclosed in U.S. Pat. Nos. 7,625,629 and 7,993,734 to Takaoka, the entirety of which are herein incorporated by reference.

The first and second sections 64, 66 may be bonded together by a bonding layer 72 in one example. The bonding layer 72 may be a resin or another type of appropriate material configured to bond adjacent polymer structures. The addition of the netted layer of the second section 66 increases the durability of the polymer fiber structure 336'.

Figure 8B:
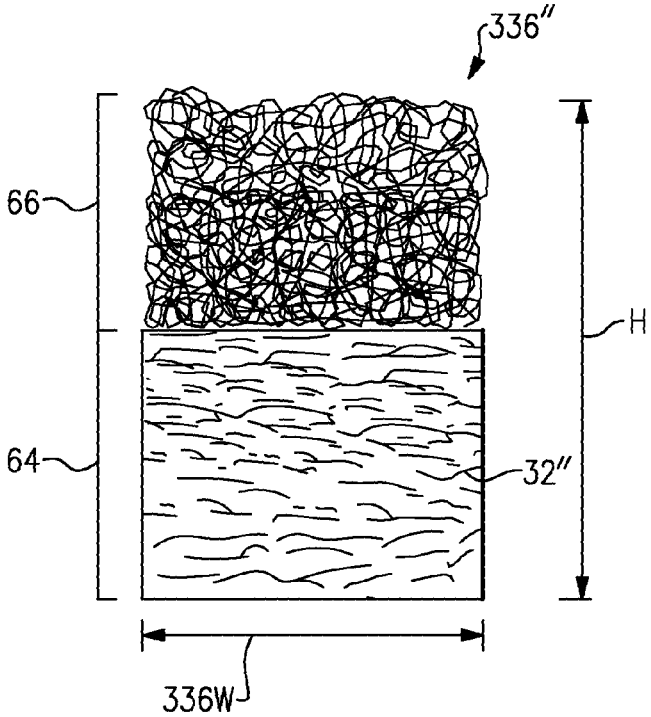
FIG. 8B is a schematic view of another polymer fiber structure including a first section having directionally oriented fibers and a second section including a netted layer.

While FIG. 8A illustrates the first section 64 adjacent the second section 66 relative to the width 336W of the polymer structure 336', the first section 64 could be positioned above or below, relative to the height H, the second section 66. FIG. 8B illustrates an example polymer structure 336" wherein the first section 64 is positioned below, relative to the height H, of the second section 66. In this example, the directionally oriented fibers 32" of the first section 64 are arranged such that they are substantially parallel to the width 336W. Alternatively, the first section 64 may include directionally oriented fibers that are arranged substantially parallel to the height H. Again, the first section 64 can be positioned above, below, or on a lateral side of the second section 66. Additionally, regardless of the position of the first section 64, the first section 64 can include directionally oriented fibers that are either oriented parallel to the height H or parallel to the width 336W.

Although an example embodiment has been disclosed, a worker of ordinary skill in this art would recognize that certain modifications would come within the scope of the claims. For that reason, the following claims should be studied to determine their true scope and content.

What is claimed is:

1. A mattress comprising:

a spring core assembly including a plurality of coil springs, the spring core assembly having a length, width, and a height, wherein the outermost coil springs provide a spring core assembly perimeter, wherein the coil springs provide a first spring rate in a direction of a height of the spring core assembly; and a polymer structure comprising polyester fibers interlinked with one another, wherein the polymer structure is arranged outside of the outermost coil springs, wherein the polymer structure provides a second spring rate in the direction of the height of the spring core assembly, wherein the second spring rate is an increased spring rate in the direction of the height of the spring core assembly relative to a polymer structure comprising only randomly oriented fibers, wherein, when the mattress is in an assembled condition, the polymer structure is arranged at the spring core assembly perimeter to provide a monolithic perimeter rail without any of the plurality of coil springs.

2. The mattress according to claim 1, wherein the coil springs are stitched together with wire.

3. The mattress as recited in claim 1, wherein the polymer structure comprises directionally oriented fibers, the directionally oriented fibers oriented to provide the polymer structure with the second spring rate in the direction of the height of the spring core assembly.

4. The mattress as recited in claim 1, wherein the polymer structure excludes coil springs.

5. The mattress as recited in claim 1, wherein, upon application of heat, at least some of the polymer fibers are configured to interlink with one another to provide the polymer structure with the second spring rate.

6. The mattress as recited in claim 1, further comprising:

at least one topper layer;

at least one quilting layer;

an insulator pad;

a base pad; and aesthetic cover.

7. The mattress as recited in claim 1, wherein the polymer structure is one of a plurality of polymer structures, wherein the plurality of polymer structures are arranged to substantially surround the spring core assembly perimeter, wherein each of the plurality of polymer structures individually provides the second spring rate in the direction of the height of the spring core assembly.

8. The mattress as recited in claim 7, wherein the plurality of polymer structures comprises first and second polymer structures having a length substantially corresponding to the width of the spring core assembly and provided at opposing first and second ends of the spring core assembly, and wherein the plurality of polymer structures further comprises third and fourth polymer structures having a length substantially corresponding to the length of the spring core assembly and provided at opposing third and fourth ends of the spring core assembly, wherein the length of the spring core assembly is longer than the width of the spring core assembly.

9. The mattress as recited in claim 1, wherein the polymer structure has a dimension corresponding to one of a length and a width of the spring core assembly.

10. The mattress as recited in claim 9, wherein the polymer structure is provided by an elongated batt having a generally rectangular cross-section.

11. A polymer structure, comprising:

a plurality of directionally oriented fibers, the directionally oriented fibers oriented in a common direction to provide an increased spring rate relative to a polymer structure comprising only randomly oriented fibers; and a three-dimensional netted layer of a plurality of helically arranged thermoplastic resin filaments, each of the thermoplastic resin filaments being partially thermally bonded to at least one of the other thermoplastic resin filaments such that the thermoplastic resin filaments are randomly entangled with one another.

12. The polymer structure as recited in claim 11, wherein the polymer structure is provided by an elongated batt having a generally rectangular cross-section, when viewed along the length of the batt.

13. The polymer structure as recited in claim 11, wherein the common direction is parallel to a height of the polymer structure.

14. The polymer structure as recited in claim 11, wherein the polymer fiber structure comprises only directionally oriented fibers.

15. The polymer structure as recited in claim 11, wherein the directionally oriented fibers are polyester fibers.

16. A mattress comprising:

an innerspring including a plurality of springs;

a polymer structure comprising directionally oriented fibers, the directionally oriented fibers oriented along a common direction, the polymer structure providing an increased spring rate relative to a polymer structure comprising only randomly oriented fibers; and wherein the polymer structure comprises (1) a first section having the directionally oriented fibers, and (2) a second section having a three-dimensional netted layer of a plurality of helically arranged thermoplastic resin filaments, each of the thermoplastic resin filaments being partially thermally bonded to at least one of the other thermoplastic resin filaments such that the thermoplastic resin filaments are randomly entangled with one another.

* * * * *